US008480773B2

(12) United States Patent
Chang et al.

(10) Patent No.: US 8,480,773 B2
(45) Date of Patent: Jul. 9, 2013

(54) METHOD OF FABRICATING A POLISHING PAD

(75) Inventors: Yung-Chung Chang, Taipei (TW); Shen-Yu Chang, Taichung (TW); Wen-Chang Shih, Taichung (TW)

(73) Assignee: IV Technologies Co., Ltd., Taichung (TW)

( * ) Notice: Subject to any disclaimer, the term of this patent is extended or adjusted under 35 U.S.C. 154(b) by 54 days.

(21) Appl. No.: 13/160,018

(22) Filed: Jun. 14, 2011

(65) Prior Publication Data

US 2011/0241258 A1 Oct. 6, 2011

Related U.S. Application Data

(62) Division of application No. 11/688,457, filed on Mar. 20, 2007.

(30) Foreign Application Priority Data

May 4, 2006 (TW) ..... 95115944 A

(51) Int. Cl.
*B24D 3/28* (2006.01)

(52) U.S. Cl.
USPC ..... 51/298; 451/526

(58) Field of Classification Search
USPC ..... 451/526, 527, 529, 530, 533, 534, 451/537, 538, 539; 51/297, 298, 293
See application file for complete search history.

(56) References Cited

U.S. PATENT DOCUMENTS

| | | | | |
|---|---|---|---|---|
| 5,212,910 | A | 5/1993 | Breivogel et al. | |
| 5,329,734 | A * | 7/1994 | Yu | 451/41 |
| 5,795,218 | A * | 8/1998 | Doan et al. | 451/526 |
| 5,913,713 | A * | 6/1999 | Cheek et al. | 451/41 |
| 6,217,426 | B1 | 4/2001 | Tolles et al. | |
| 6,623,331 | B2 * | 9/2003 | Sevilla et al. | 451/6 |
| 6,632,129 | B2 | 10/2003 | Goetz | |
| 7,132,070 | B2 | 11/2006 | Shih et al. | |
| 7,285,233 | B2 | 10/2007 | Shih et al. | |

FOREIGN PATENT DOCUMENTS

| | | |
|---|---|---|
| TW | 528657 B | 4/2003 |
| TW | 592894 B | 6/2004 |

OTHER PUBLICATIONS

Chinese Office Action for corresponding CN Application No. 200610082010X, dated Oct. 24, 2008, pp. 1-12, China.

* cited by examiner

*Primary Examiner* — Robert Rose
(74) *Attorney, Agent, or Firm* — Ditthavong Mori & Steiner P.C.

(57) ABSTRACT

A polishing pad having a compressibility-aiding stripe buried therein is fabricated by assembling the compressibility-aiding stripe in a mold cavity, filling the mold cavity with a polymer material, and releasing the polishing pad from the mold. Embodiments include assembling a compressibility-aiding stripe comprising a solid pillar of material having a larger compressibility than that of the polishing pad body, and releasing a single layer polishing pad from the mold.

24 Claims, 8 Drawing Sheets

METHOD OF FABRICATING A POLISHING PAD

RELATED APPLICATIONS

This application is a Divisional of U.S. application Ser. No. 11/688,457, filed Mar. 20, 2007, which claims priority to Taiwan Application Serial Number 95115944, filed May 4, 2006, which is herein incorporated by reference.

BACKGROUND

1. Field of Invention

The present invention relates to a polishing pad and the method thereof. More particularly, the present invention relates to a polishing pad with high rigidity and high compressibility utilized in Chemical Mechanical Polish (CMP).

2. Description of Related Art

Chemical Mechanical Polishing (CMP) is a process that is used to flatten the semiconductor wafers. CMP takes advantage of the synergetic effect of both physical and chemical forces for polishing of wafers and applies a load force on the back of a wafer while it rests on a polishing pad. Both the polishing pad and wafer are then counter rotated while a slurry containing both abrasives and reactive chemicals passes underneath. CMP is an effective way for uniformly flatting the entire substrate.

The goal of CMP is to uniformly flatten the entire wafer and reproduce the flatness on wafers. Wafer flatness depends on the rigidity and the compressibility of the polishing pad. For example, a high-rigidity polishing pad may increase the flatness of the wafers, and a high-compressibility polishing pad may increase the uniformity of the wafers. As a result, a high-compressibility polishing pad may be used after a high-rigidity polishing pad to increase the uniformity of the wafers, and that may spend more time and reduce the productivity of the wafers. The material of the known polishing pad is difficult to balance rigidity and compressibility.

For the forgoing reasons, there is a need for a polishing pad having desired rigidity and compressibility.

SUMMARY

It is therefore an objective of the present invention to provide a polishing pad and a method thereof to increase the flatness and the uniformity of the CMP process.

It is another objective of the present invention to provide a polishing pad and a method to produce a polishing pad having desired rigidity and compressibility.

In accordance with the foregoing and other objectives of the present invention, a polishing pad includes a polishing pad body, and at least a compressibility-aiding stripe buried in the polishing pad body, wherein a compressibility of the compressibility-aiding stripe is larger than a compressibility of the polishing pad body.

An embodiment of the present invention provides a fabricating method of a polishing pad. First, assembling a compressibility-aiding stripe forming structure in a polishing pad mold, wherein the compressibility-aiding stripe structure has at least a bar to define at least a compressibility-aiding stripe in a polishing pad. Second, filling a polymer material in a mold cavity of the polishing pad mold to form a polishing pad body, wherein the bar is covered in the polymer material. Third, releasing the compressibility-aiding stripe forming structure from the polishing pad body to generate the polishing pad with a space channel compressibility-aiding stripe.

An embodiment of the present invention provides a fabricating method for a polishing pad. First, assembling at least a compressibility-aiding stripe in a polishing pad mold. Second, filling a polymer material in a mold cavity of the polishing pad mold to form a polishing pad body, wherein the compressibility-aiding stripe is covered in the polymer material. Third, releasing the polishing pad body from the polishing pad mold to generate a polishing pad with the compressibility-aiding stripe buried within.

An embodiment of the present invention provides a fabricating method of a polishing pad. First, forming a polishing pad body having a top surface, a bottom surface, and a side connecting to the top surface and the bottom surface. Second, drilling the side of the polishing pad body.

As embodied and broadly described herein, a polishing pad with desired rigidity and compressibility for better flatness of the wafers is provided.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiments, with reference made to the accompanying drawings as follows.

DESCRIPTION OF THE EMBODIMENTS

Figure 1A:
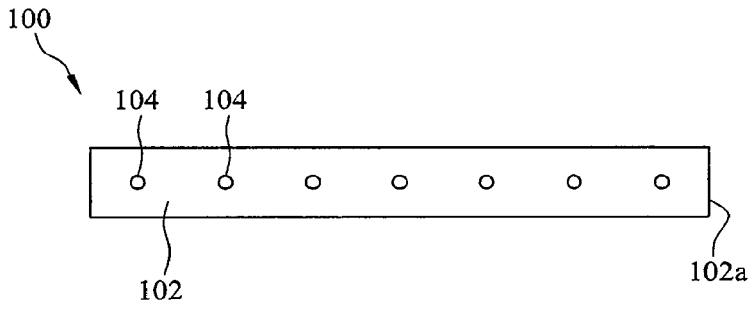
FIG. 1A illustrates a lateral view diagram according to a first embodiment of the polishing pad.

Reference will now be made in detail to the present embodiments of the invention, examples of which are illustrated in the accompanying drawings. Wherever possible, the same reference numbers are used in the drawings and the description to refer to the same or like parts.

The invention provides a polishing pad with desired rigidity and compressibility utilized in the CMP process and fabricating methods thereof.

FIG. 1A to FIG. 1D illustrate a lateral view diagram and top view diagrams of the first embodiment of a polishing pad. Polishing pad 100 includes a polishing pad body 102, and at least a compressibility-aiding stripe 104 buried in the polishing pad body 102 between a top surface and a bottom surface of the polishing pad body 102. The compressibility of the compressibility-aiding stripe 104 is larger than the compressibility of the polishing pad body 102 to increase the compressibility of the polishing pad 100.

Figure 1B:
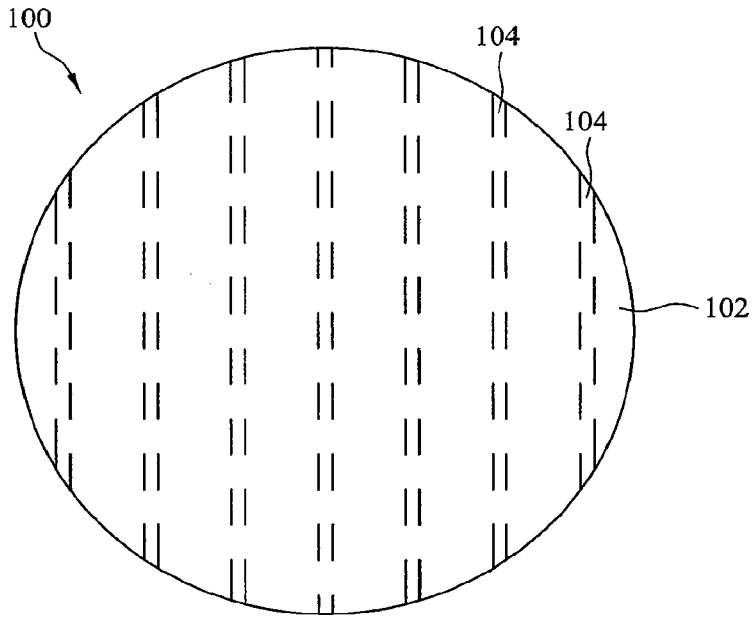
FIG. 1B to FIG. 1D illustrate the top view diagrams according to the polishing pad of the first embodiment.
Figure 1C:
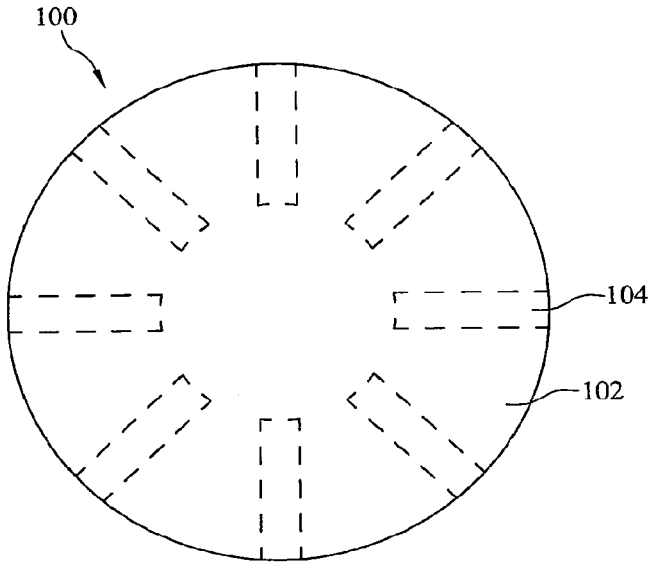
Figure 1D:
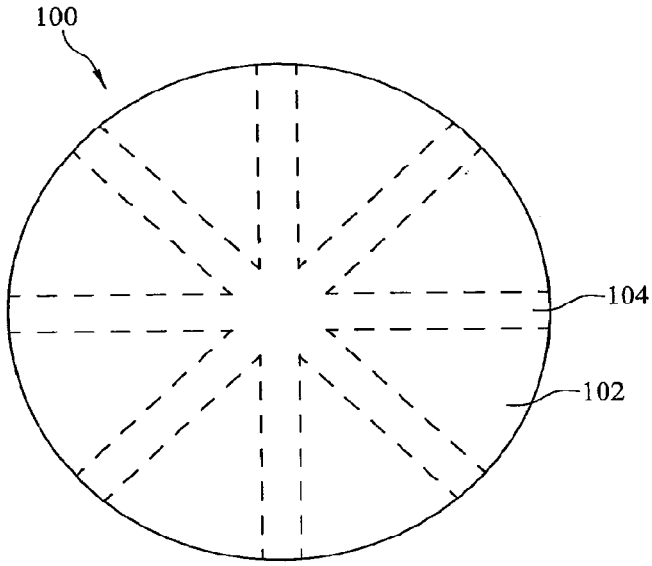

The compressibility-aiding stripe 104 may cross through the polishing pad body 102 in a parallel arrangement as FIG. 1B shown. In a radial arrangement as shown in FIG. 1C, one end of the radial disposed compressibility-aiding stripes 104 may be formed on the polishing pad side 102*a*, and the other end may be buried in the polishing pad body 102, and each compressibility-aiding stripe 104 is isolated. In another radial arrangement as shown in FIG. 1D, the compressibility-aiding stripes 104 are radial disposed and associated in the middle of the polishing pad body 102. The compressibility of the compressibility-aiding stripe 104 is larger than the compressibility of the polishing pad body 102. To increase the compressibility of the polishing pad 100, the polishing pad 100 may have the compressibility-aiding stripe 104 buried within, and the material of the compressibility-aiding stripe 104 may be a solid body, such as a solid pillar or a hollow tube, or be an empty space containing air.

Figure 2:
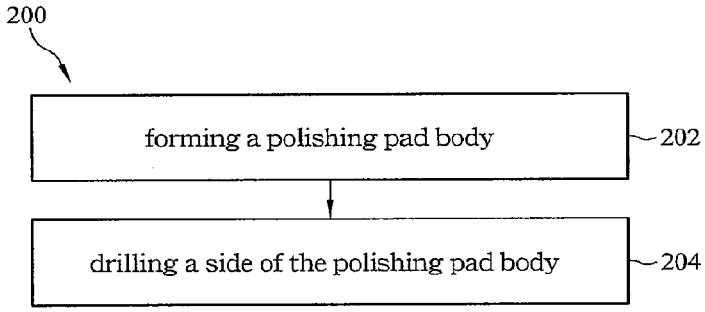
FIG. 2 illustrates a flow chart according to the fabricating method of the polishing pad of the first embodiment.

FIG. 2 illustrates a flow chart of a fabricating method of the first embodiment of the polishing pad. In the present embodiment, the fabricating method 200 includes following steps. The polishing pad body 102 forms in step 202. The polishing pad body 102 has a top surface, a bottom surface, and a side connecting to the top surface and the bottom surface. In step 204, the polishing pad body 102 is drilled at the side 102*a* to form the compressibility-aiding stripe 104 of the space channel. Mechanical drilling, laser drilling, or combination thereof is used in step 204.

In this embodiment, the polishing pad 100 may be formed in a mold and the side 102*a* may be drilled to generate the compressibility-aiding stripes 104 with air.

Figure 3:
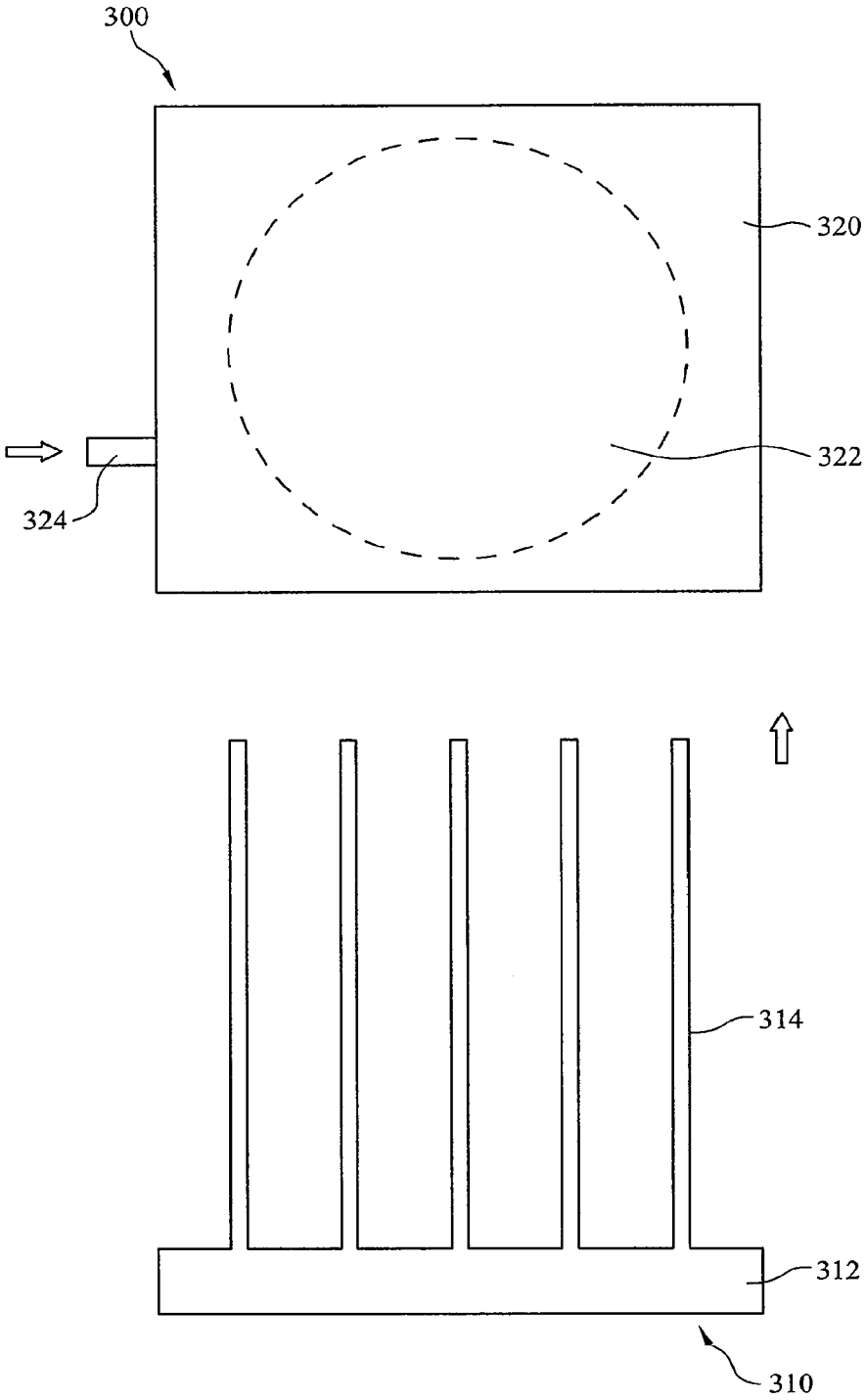
FIG. 3 illustrates a schematic diagram according to the polishing pad fabricating apparatus of a second embodiment.

FIG. 3 illustrates a schematic diagram according to a second embodiment of the polishing pad fabricating apparatus. The polishing pad fabricating apparatus 300 includes a compressibility-aiding stripe forming structure 310 and a polishing pad mold 320. The compressibility-aiding stripe forming structure 310 includes a base 312 and at least a bar 314 connecting to the base 312. The polishing pad mold 320 has a mold cavity 322 to form polishing pad 100. The polishing pad mold 320 further has an inlet 324 to let a polymer material fill the mold cavity 322 through the inlet 324.

Figure 4:
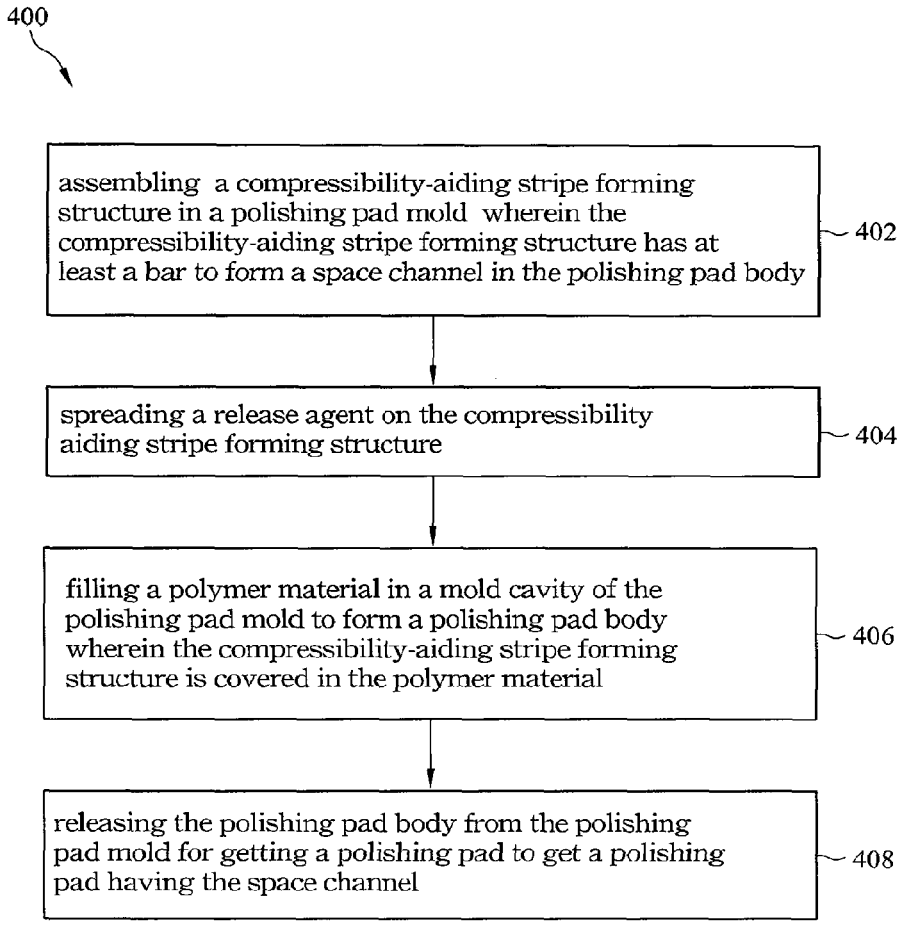
FIG. 4 illustrates a flow chart according to the polishing pad fabricating method of the second embodiment.

FIG. 4 illustrates a flow chart according to the polishing pad fabricating method 400 of the second embodiment. In step 402 a compressibility-aiding stripe forming structure 310 is assembled in the polishing pad mold 320, wherein the compressibility-aiding stripe forming structure 310 has at least a bar 314 to form the space channel compressibility-aiding stripe 104 in the polishing pad body 102. The bars 314 may be disposed in parallel and the cross-section shape of the bar 314 may be an ellipse, a circle, or a polygon. The bar 314 of the compressibility-aiding stripe forming structure 310 is assembled in the mold cavity 322 between the top surface and the bottom surface of the polishing mold 320. The thickness of the polishing pad body 102 is about 6 mm and the diameter of the bar 314 is about 1 mm in the present embodiment.

In step 406, a polymer material is filled in the mold cavity 322 of the polishing pad mold 320 to form the polishing pad body 102. The polishing pad body 102 is composed of the polymer material, such as polyurethane (PU) foam. The polymer material may fill the mold cavity 322 through the inlet 324. In step 408, the polishing pad body 102 is released from the polishing pad mold 320 and the compressibility-aiding stripe forming structure 310 is released from the polishing pad body 102 to generate the polishing pad 100 with the space channel compressibility-aiding stripe 104. The top view diagram of the present embodiment is shown in FIG. 1B. The space channel compressibility-aiding stripe 104 may pass through the polishing pad body 102 or has one end buried in the polishing pad body 102 by selecting proper length of the bar 314.

Method 400 may alternatively include step 404, in which a release agent is spread on the compressibility-aiding stripe forming structure 310. The release agent may be a wax, a fluorine containing resin, or a silicon containing resin to prevent the damage of the polishing pad body 102. The material of the compressibility-aiding stripe forming structure 310 may be a metal, a low surface energy material (such as Teflon or a silicon rubber), or a composite material coated with the low surface energy material. Step 404 may be omitted if the compressibility-aiding stripe forming structure 310 is made of the low surface energy material.

Figure 5A:
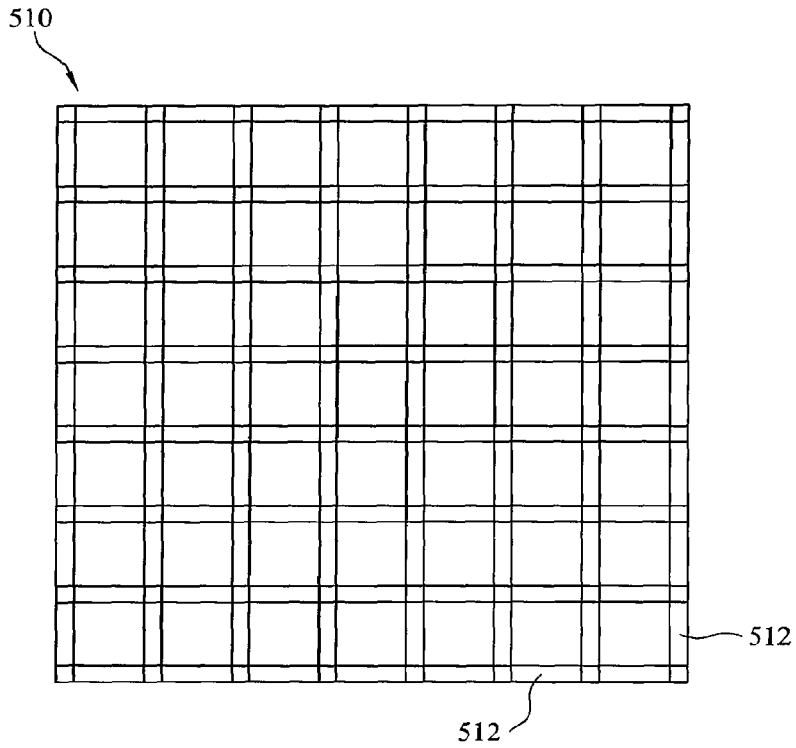
FIG. 5A illustrates a top view diagram according to a compressibility-aiding stripe forming frame of a third embodiment.
Figure 5B:
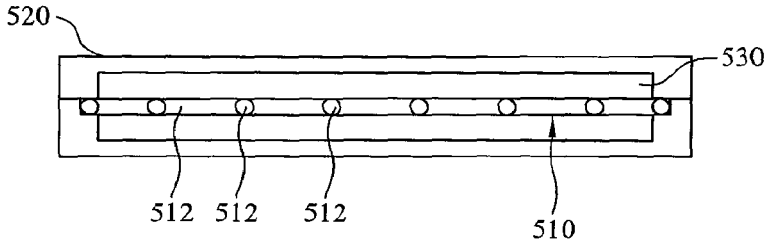
FIG. 5B illustrates a lateral view diagram according to a polishing pad fabricating apparatus of the third embodiment.

FIG. 5A illustrates a top view diagram of a compressibility-aiding stripe forming frame of a third embodiment, and FIG. 5B illustrates a lateral view diagram according to a polishing pad fabricating apparatus of the third embodiment. The compressibility-aiding stripe forming frame 510 is a reticular frame composed of a plurality of compressibility-aiding stripes 512, and the compressibility of the compressibility-aiding stripes 512 is larger than the compressibility of the polishing pad body 102. The material of the compressibility-aiding stripes 512 may be a rubber or a polyurethane foam. The compressibility-aiding stripe forming frame 510 is constructed in the polishing pad mold 520.

Figure 6:
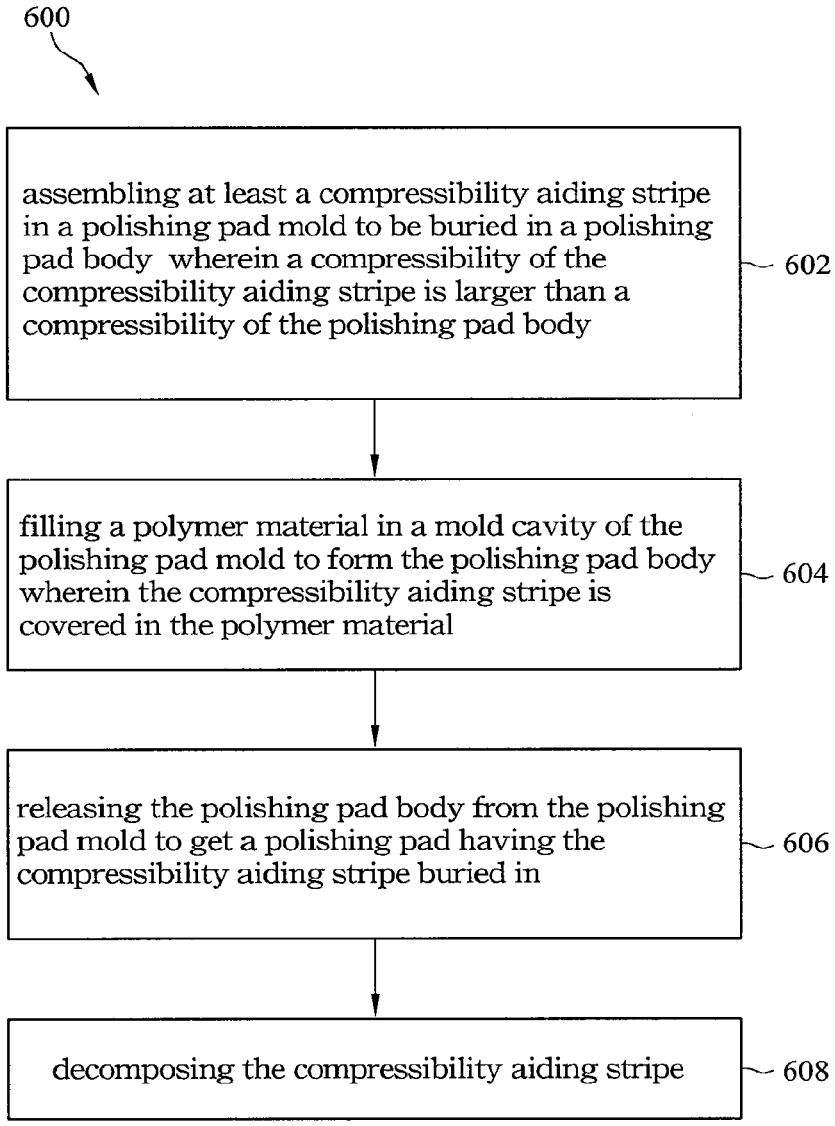
FIG. 6 illustrates a flow chart according to the polishing pad fabricating method of the third embodiment.

FIG. 6 illustrates a flow chart according to the polishing pad fabricating method of the third embodiment. Method 600 starts at step 602, in which the compressibility-aiding stripe forming frame 510 is assembled in the polishing pad mold 520. The compressibility-aiding stripes 512 of the compressibility-aiding stripe forming frame 510 is reticular disposed.

In step 604, the polymer material is filled in the mold cavity 530 of the polishing pad mold 520 to form the polishing pad body 102. The compressibility-aiding stripe forming frame 510 has the compressibility-aiding stripes 512 buried in the polishing pad body 102, and the compressibility of the compressibility-aiding stripes 512 is larger than the compressibility of the polishing pad body 102. The compressibility-aiding stripes 512 are covered in the polymer material. In step 606, the polishing pad body 102 is released from the polishing pad mold 520 and unnecessary material surrounding the polishing pad 100 is cut off and remained a part of the compressibility-aiding stripes 512 in the polishing pad 100. The method 600 may alternatively include step 608 to decompose the compressibility-aiding stripes 512 to form the space channel compressibility-aiding stripes 512 in the polishing pad 100 if the material of the compressibility-aiding stripes 512 is a decomposable material, such as a polyvinyl alcohol (PVA), a poly lactic acid (PLA), or a polystyrene (PS). Different solvents are used respectively for different decomposable material, for example, water may dissolve PVA and PLC, an organic solvent, such as a dichloromethane ($CHCl_2$), may dissolve PS. The space channel structure is formed in the polishing pad body 102 to increase the compressibility of the polishing pad 100 after the compressibility-aiding stripes 512 are dissolved.

Figure 7A:
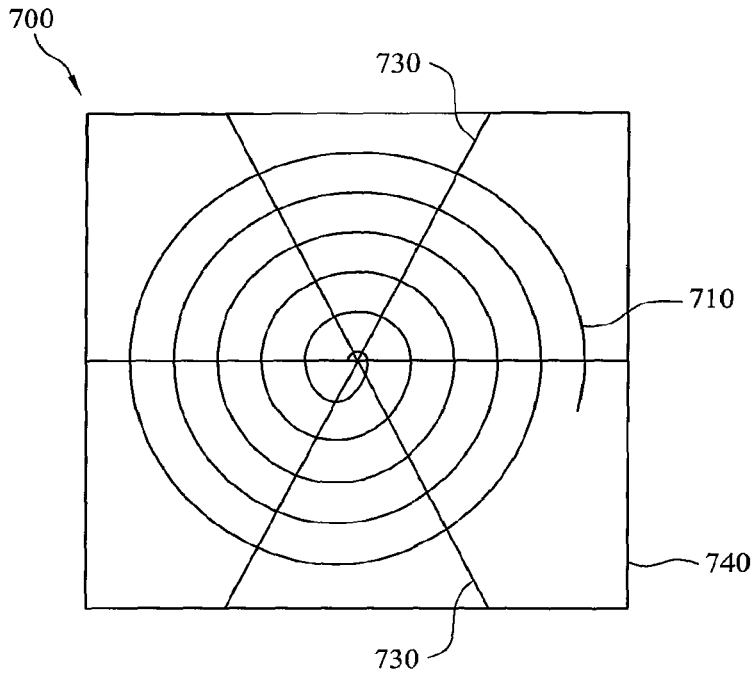
FIG. 7A to FIG. 7B illustrate top view diagrams according to different compressibility-aiding stripe forming frames of the third embodiments.
Figure 7B:
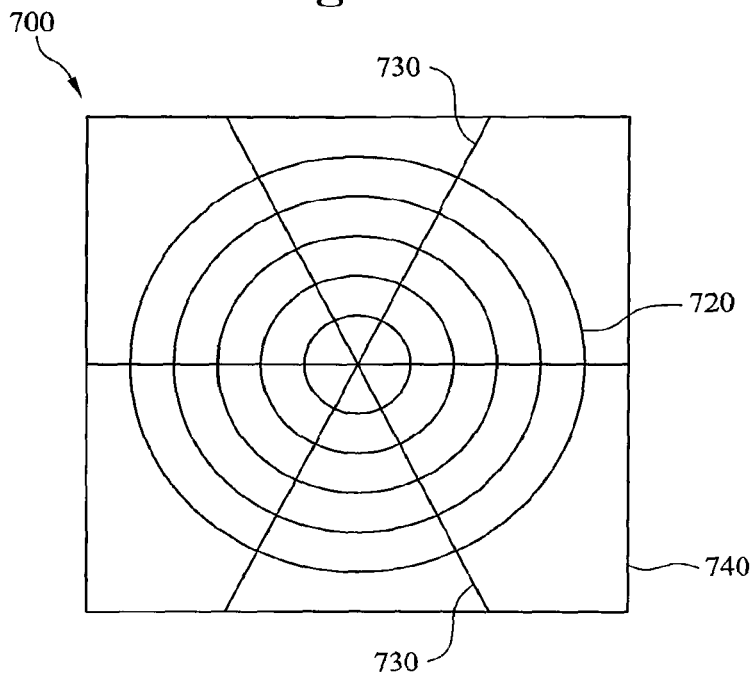

FIG. 7A to FIG. 7B illustrate top view diagrams according to different compressibility-aiding stripe forming frames of the third embodiments. Another arrangement of the compressibility-aiding stripe forming frame 700 may be a spiral arrangement compressibility-aiding stripe 710 (as shown in FIG. 7A) or a concentric arrangement compressibility-aiding stripe 720 (as shown in FIG. 7B). The compressibility-aiding stripe 710 and 720 may remain in a plane by a support structure 730. Two ends of the support structure are fixed on a frame 740. The material of the support structure 730 may be a nylon fiber, a PET fiber or a PU fiber. The material of the frame 740 may be a metal material or a polymer material. The support structure 730 and the compressibility-aiding stripe 710 and 720 may be an integrated structure or be fixed by an adhesive. After the polishing pad body 102 is released from the polishing pad mold 520, cutting a part of the support structure 730 and the frame 740 to generate the polishing pad 100 with the compressibility-aiding stripe 710 and 720 buried within.

The compressibility-aiding stripe is disposed between the top surface and the bottom surface of the polishing pad body. The disposed direction of the compressibility-aiding stripe may be parallel to the top surface of the polishing pad body, or may tilt an angle to the top surface of the polishing pad body. The compressibility-aiding stripe arrangement may be a parallel arrangement, a radial arrangement, a reticular arrangement, a spiral arrangement, a concentric arrangement, or other possible arrangement. The length of the compressibility-aiding stripe varies corresponding to various arrangements and usually is larger than half of the radius of the polishing pad. The cross-section shape of the compressibility-aiding stripe may be an ellipse, a circle, a polygon, or other possible shape. The arrangement of the compressibility-aiding stripes may also be a multi-layer arrangement.

An advantage of the invention provides a polishing pad with desired rigidity and compressibility to increase the flatness and uniformity of wafers in the CMP process. The compressibility-aiding stripes or the space channels buried in the polishing pad may increase the compressibility of the polishing pad. The cross-section dimension of the compressibility-aiding stripe is approximately between 50 μm to 2 mm. In an embodiment, the cross-section dimension of the compressibility-aiding stripe is between 100 μm to 1 mm.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method of fabricating a polishing pad, the method comprising:

assembling a compressibility-aiding stripe forming structure in a polishing pad mold, the compressibility-aiding stripe forming structure comprising a solid pillar of material to define at least a compressibility-aiding stripe in a polishing pad;

filling a mold cavity of the polishing pad mold with a polymer material such that the polymer material covers the solid pillar to form a polishing pad body; and releasing the compressibility-aiding stripe forming structure from the polishing pad body to generate the polishing pad with at least a space channel compressibility-aiding stripe.

2. The method of claim 1, wherein a cross-section dimension of the solid pillar of material is about 50 μm to 2 mm.

3. The method of claim 1, wherein the polymer material comprises a polyurethane foam.

4. The method of claim 1, wherein the solid pillar of material comprises a material selected from the group consisting of a metal material, a low surface energy material, and a composite material coated with a low surface energy material.

5. The method of claim 1, further comprising spreading a release agent on the compressibility-aiding stripe forming structure before filling the mold cavity.

6. A method of fabricating a polishing pad, the method comprising:

assembling at least a compressibility-aiding stripe in a polishing pad mold, the compressibility-aiding stripe formed of a solid pillar of material;

filling a mold cavity of the polishing pad mold with a polymer material such that the compressibility-aiding stripe is covered by the polymer material to form a polishing pad body; and releasing the polishing pad body from the polishing pad mold to generate a polishing pad with the compressibility-aiding stripe buried within.

7. The method of claim 6, wherein the compressibility of the compressibility-aiding stripe is larger than the compressibility of the polishing pad.

8. The method of claim 6, wherein the compressibility-aiding stripe comprises a rubber or a polyurethane foam.

9. The method of claim 6, comprising assembling a compressibility-aiding stripe forming frame in the polishing pad mold, wherein the compressibility-aiding stripe forming frame has at least a compressibility-aiding stripe.

10. The method of claim 6, further comprising cutting an unnecessary material surrounding the polishing pad and retaining a part of the compressibility-aiding stripe in the polishing pad after releasing polishing pad body from the polishing pad mold.

11. The method of claim 6, wherein the compressibility-aiding stripe comprises a decomposable material.

12. The method of claim 11, wherein the compressibility-aiding stripe comprises a polyvinyl alcohol, a poly lactic acid, or a polystyrene.

13. The method of claim 11, further comprising decomposing the compressibility-aiding stripe after forming the polishing pad with the compressibility-aiding stripe buried within.

14. The method of claim 6, wherein: the polishing pad body comprises a single layer; and the solid pillar of material has a compressibility larger than a compressibility of the polishing pad body.

15. The method of claim 14, wherein the compressibility-aiding stripe has a cross-section shape selected from the group consisting of a circle, an ellipse, a polygon, and a combination thereof.

16. The method of claim 14, wherein a cross-section dimension of the compressibility-aiding stripe is about 50 μm to 2 mm.

17. The method of claim 14, wherein the polishing pad comprises a polymer foam.

18. The method of claim 14, further comprising assembling at least one solid body compressibility-aiding stripe comprising a hollow tube, in the polishing pad mold.

19. The method of claim 14, comprising assembling a plurality of compressibility-aiding stripes in the polishing pad mold in an arrangement selected from the group consisting of a parallel arrangement, a radial arrangement, a reticular arrangement, a spiral arrangement, a concentric arrangement, and a combination thereof.

20. The method of claim 19, wherein the arrangement is a single-layer arrangement or a multi-layer arrangement.

21. The method of claim 14, wherein the compressibility-aiding stripe passes through the polishing pad body.

22. The method of claim 14, wherein an end of the compressibility-aiding stripe is formed on a side of the polishing pad body, and another end of the compressibility-aiding stripe is buried in the polishing pad body.

23. The method of claim 14, wherein the compressibility-aiding stripe is disposed between a top surface and a bottom surface of the polishing pad body.

24. The method of claim 23, wherein the compressibility-aiding stripe is disposed in a direction parallel to the top surface of the polishing pad body, or tilts at an angle to the top surface of the polishing pad body.

* * * * *